US011598350B2

(12) United States Patent
Choi et al.

(10) Patent No.: US 11,598,350 B2
(45) Date of Patent: Mar. 7, 2023

(54) FAN MOTOR AND MANUFACTURING METHOD THEREOF

(71) Applicant: LG Electronics Inc., Seoul (KR)

(72) Inventors: Joongkeun Choi, Seoul (KR); Jeongho Lee, Seoul (KR); Giyeob Yang, Seoul (KR); Seongho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 84 days.

(21) Appl. No.: 16/836,195

(22) Filed: Mar. 31, 2020

(65) Prior Publication Data

US 2021/0010486 A1 Jan. 14, 2021

(30) Foreign Application Priority Data

Jul. 10, 2019 (KR) ..... 10-2019-0083458

(51) Int. Cl.

| | |
|---|---|
| ***F04D 29/44*** | (2006.01) |
| ***F04D 17/16*** | (2006.01) |
| ***F04D 25/06*** | (2006.01) |
| ***F04D 29/62*** | (2006.01) |
| *F04D 25/08* | (2006.01) |

(52) U.S. Cl.

CPC ..... *F04D 29/444* (2013.01); *F04D 17/165* (2013.01); *F04D 25/0606* (2013.01); *F04D 29/624* (2013.01); *F04D 25/082* (2013.01)

(58) Field of Classification Search

None

See application file for complete search history.

(56) References Cited

U.S. PATENT DOCUMENTS

| | | | | |
|---|---|---|---|---|
| 10,598,189 | B2 * | 3/2020 | Liu | F04D 25/08 |
| 2014/0294578 | A1 | 10/2014 | Oh | |
| 2017/0051755 | A1 * | 2/2017 | Liu | F04D 29/056 |
| 2017/0102005 | A1 | 4/2017 | Schuldt et al. | |
| 2019/0063458 | A1 | 2/2019 | Oh | |
| 2021/0207617 | A1 * | 7/2021 | Johnson | F04D 17/06 |

FOREIGN PATENT DOCUMENTS

| | | |
|---|---|---|
| CN | 107614888 | 1/2018 |
| CN | 207049073 | 2/2018 |
| CN | 108980074 | 12/2018 |
| CN | 109340187 | 2/2019 |
| EP | 1731070 | 12/2006 |
| EP | 3133294 | 2/2017 |
| EP | 3376043 | 9/2018 |

(Continued)

OTHER PUBLICATIONS

AU Office Action in Australian Appln. No. 2020201734, dated Mar. 17, 2021, 8 pages.

(Continued)

*Primary Examiner* — Juan G Flores

(74) *Attorney, Agent, or Firm* — Fish & Richardson P.C.

(57) ABSTRACT

Disclosed is a fan motor. The present disclosure provides a fan motor including a motor housing receiving a motor therein, a motor bracket disposed on the motor housing, an impeller coupled to a shaft of the motor, and a diffuser disposed between the motor and the impeller and having a vane body, an axial flow vane provided to an inner circumference of the vane body, and a diagonal flow vane provided above the axial flow vane.

6 Claims, 8 Drawing Sheets

(56) References Cited

FOREIGN PATENT DOCUMENTS

| | | | | |
|---|---|---|---|---|
| JP | 2005307985 | | | 11/2005 |
| JP | 2005307985 | A | * | 11/2005 |
| JP | 2010041756 | | | 2/2010 |
| JP | 2010281232 | | | 12/2010 |
| JP | 2012255413 | | | 12/2012 |
| JP | 2016133105 | | | 7/2016 |
| KR | 1020140118456 | | | 10/2014 |
| KR | 1020150080876 | | | 7/2015 |
| KR | 1020180105934 | | | 10/2018 |

OTHER PUBLICATIONS

Extended European Search Report in European Application No. 20162067.1, dated Sep. 4, 2020, 8 pages.
Taiwanese Office Action in Taiwanese Application No. 109106099, dated Nov. 11, 2020, 11 pages (with English translation).
Office Action in European Appln. No. 20162067.1, dated Dec. 8, 2022, 5 pages.

* cited by examiner

FAN MOTOR AND MANUFACTURING METHOD THEREOF

CROSS-REFERENCE TO RELATED APPLICATION

Pursuant to 35 U.S.C. § 119(a), this application claims the benefit of earlier filing date and right of priority to Korean Application No. 10-2019-0083458, filed on Jul. 10, 2019, the contents of which is hereby incorporated by reference herein in its entirety.

BACKGROUND

Field of the Disclosure

The present disclosure relates to a motor and manufacturing method thereof, and more particularly, to a fan motor and manufacturing method thereof.

Discussion of the Related Art

A fan motor is a sort of an actuator that generates a rotational force. The fan motor generates a suction force by rotation of a fan (e.g., impeller) connected to a rotating shaft of a motor. Fan motors are used for various devices. Fan motors are used for home appliances such as cleaners, air conditioners, etc., cars, etc. For example, when a fan motor is used for a cleaner, air sucked by the fan motor flows into a filter of the cleaner.

Generally, a fan motor consists of a motor and an impeller connected to a rotating shaft of the motor. And, a diffuser may be provided between the motor and the impeller.

Once the motor rotates, the impeller connected to the rotating shaft is rotated as well. By rotation of the impeller, air is sucked in a direction of the impeller. The air coming out of the impeller is guided by a diffuser and then discharged in a direction of the motor.

Problems of a fan motor of the related art are described as follows.

First of all, problems of an impeller of the related art are described.

An impeller may include a hub and a multitude of blades provided to the hub. However, as the related art employs a centrifugal impeller, a centrifugal flow is generated from the impeller.

In the related art, a hub line of the impeller extends in a diameter direction, whereby a flow coming out of the impeller is discharged in the diameter direction. Therefore, the flow passing through the impeller is rapidly turned at almost 90 degrees and goes in a diffuser direction.

Generally, a flow path loss is heavy in an area where a flow is rapidly turned and flow path efficiency is poor. Yet, as described above, since the flow is rapidly turned in the related art impeller, a flow path loss is heavy and flow path efficiency is poor.

Problems of a diffuser of the related are described in the following.

A diffuser may include a hub and a multitude of vanes provided to the hub. Yet, as an axial flow diffuser is used in the related art, an axial flow is generated from the diffuser.

In the related art, the vanes are provided to the hub in an axial direction. Hence, a flow coming out of an impeller is rapidly turned to enter the vanes. This is because the flow comes out of the impeller in an approximately diameter direction and because the vanes of the diffuser are provided in an axial direction. Therefore, the related art diffuser has a heavy flow path loss and poor flow path efficiency.

Meanwhile, there exists a section (hereinafter referred to as 'vaneless section') in which no vane of a diffuser is present between an impeller and the diffuser, and such a vaneless section is long. However, the vaneless section fails to guide a flow due to absence of vanes. Therefore, in vaneless section of a related art fan motor, a flow path loss is heavy and flow path efficiency is poor.

Meanwhile, in the related art, a length of a vane of a diffuser is short. However, if the length of the vane of the diffuser is short, a flow cannot be guided effectively. Therefore, the related art diffuser has a small diffuser effect and poor flow path efficiency.

As described above, a related art fan motor has a heavy flow path loss in a diffuser. Therefore, the related art fan motor disadvantageously has poor flow path efficiency and lowered total efficiency of the fan motor. Moreover, as a fan motor is downsized and tends to have ultra-high speed, it is further necessary to reduce a flow path loss and improve flow path efficiency.

The above-described fan motor of the related art is disclosed in Korean Patent No. 1454083, U.S. Patent Laid-Open 2014/268636, European Patent No. 01025792 B1, U.S. Pat. No. 5,592,716, Korean Patent No. 1289026, Korean Patent Laid-Open No. 10-2014-0070303, etc.

SUMMARY

Accordingly, embodiments of the present disclosure are directed to a fan motor and manufacturing method thereof that substantially obviate one or more problems due to limitations and disadvantages of the related art.

One object of the present disclosure is to provide a fan motor having an impeller and manufacturing method thereof, by which a flow path loss may be reduced and flow path efficiency may be improved.

Another object of the present disclosure is to provide a fan motor having a diffuser and manufacturing method thereof, by which a flow path loss may be reduced and flow path efficiency may be improved.

Another object of the present disclosure is to provide a fan motor and manufacturing method thereof, by which a vaneless section between an impeller and a diffuser may be minimized.

Another object of the present disclosure is to provide a fan motor and manufacturing method thereof, by which a vane length of a diffuser may be maximized.

Another object of the present disclosure is to provide a fan motor and manufacturing method thereof, by which efficiency of the fan motor may be improved.

Another object of the present disclosure is to provide a fan motor having an easily manufactured diffuser and manufacturing method thereof.

Further object of the present disclosure is to provide a fan motor and manufacturing method thereof, by which a flow may be guided efficiently.

Additional advantages, objects, and features of the disclosure will be set forth in the disclosure herein as well as the accompanying drawings. Such aspects may also be appreciated by those skilled in the art based on the disclosure herein.

According to an embodiment of the present disclosure, an impeller is a diagonal flow type. Hence, in the impeller, a flow path loss may be reduced and flow path efficiency may be improved.

According to an embodiment of the present disclosure, a diffuser includes a diagonal flow type. Hence, in the diffuser, a flow path loss may be minimized but flow path efficiency may be maximized.

According to an embodiment of the present disclosure, a vane of a diffuser, e.g., a diagonal flow vane is provided to a vaneless section. Hence, the vaneless section between an impeller and the diffuser may be minimized. Hence, a flow path loss may be minimized but flow path efficiency may be maximized.

According to an embodiment of the present disclosure, a diagonal flow vane is provided above an axial flow vane of a diffuser, thereby maximizing an overall length of the vane. Hence, a flow path loss may be minimized but flow path efficiency may be maximized.

According to an embodiment of the present disclosure, a diffuser consists of two parts including a hub and a vane structure. Hence, manufacture of the diffuser is facilitated.

According to an embodiment of the present disclosure, a vane structure is fixed using another part of a fan motor. Hence, assembling is improved.

According to an embodiment of the present disclosure, a vane is provided within a vane body. Hence, a flow is efficiently guided in the vane.

To achieve these objects and other advantages and in accordance with the purpose of the disclosure, as embodied and broadly described herein, a fan motor according to one embodiment of the present disclosure may include a motor housing receiving a motor therein, a motor bracket disposed on the motor housing, an impeller coupled to a shaft of the motor, and a diffuser disposed between the motor and the impeller and having a vane body, an axial flow vane provided to an inner circumference of the vane body, and a diagonal flow vane provided above the axial flow vane.

According to an exemplary embodiment of the present disclosure, the vane body may include a hollow ring and wherein the axial flow vane is provided to an inner surface of the ring.

According to an exemplary embodiment of the present disclosure, the vane body, the axial flow vane and the diagonal flow vane may be integrally provided.

According to an exemplary embodiment of the present disclosure, the vane body, the axial flow vane and the diagonal flow vane may be formed by injection molding.

According to an exemplary embodiment of the present disclosure, a hub may be provided within the vane body and a shape of a top portion of an outer circumference of the hub may be related to a shape of the diagonal flow vane.

According to an exemplary embodiment of the present disclosure, an indentation may be provided to the vane body and wherein a fitted part corresponding to the indentation is provided to the motor bracket.

According to an exemplary embodiment of the present disclosure, the indentation may include at least one of a first indentation provided in a circumferential direction or a second indentation provided in an axial direction and the fitted part may include at least one of a first fitted part related to the first indentation and a second fitted part related to the second indentation.

According to an exemplary embodiment of the present disclosure, the motor bracket may include a bearing housing, a support part and a bridge connecting the bearing housing and the support part to each other and the fitted part may be provided to an outside of the support part.

According to an exemplary embodiment of the present disclosure, one end of the second fitted part may be connected to a lateral side of the bridge.

According to an exemplary embodiment of the present disclosure, the impeller is received in an impeller housing and a top portion of the vane body may be supported by an inner surface of the impeller housing.

According to an exemplary embodiment of the present disclosure, a step difference may be provided to the inner surface of the impeller housing and the top portion of the vane body may be supported by the step difference.

According to an exemplary embodiment of the present disclosure, an outer diameter of the vane body may be related to an inner diameter of the impeller housing.

In another aspect of the present disclosure, as embodied and broadly described herein, a fan motor according to another embodiment of the present disclosure may include a motor housing receiving a motor therein, a motor bracket disposed on a top side of the motor housing, an impeller coupled to a shaft of the motor, an impeller housing receiving the impeller therein, and a diffuser disposed between the motor and the impeller and having a vane body supported by an inside of the impeller housing and a vane provided to an inner circumference of the vane body.

According to an exemplary embodiment of the present disclosure, the vane may include an axial flow vane and a diagonal flow vane provided to a top side of the axial flow vane.

According to an exemplary embodiment of the present disclosure, a step difference may be provided to an inner surface of the impeller housing and a top portion of the vane body may contact with the step difference.

According to an exemplary embodiment of the present disclosure, an inner diameter of the impeller housing may be related to an outer diameter of the vane body.

According to an exemplary embodiment of the present disclosure, a hub may be provided within the vane body and a top surface of an outer circumference of the hub may support the diagonal flow vane.

According to an exemplary embodiment of the present disclosure, an indentation may be provided to the vane body and a fitted part related to the indentation may be provided to the motor bracket.

In further aspect of the present disclosure, as embodied and broadly described herein, a method of manufacturing a fan motor according to further embodiment of the present disclosure may include a first step of preparing a vane body having a hollow part and a vane provided to an inner circumference thereof and a second step of assembling a hub to the hollow part of the vane body.

According to an exemplary embodiment of the present disclosure, in the second step, the hub may be coupled to a motor bracket, the vane body may be fixed in a circumferential direction in a manner that a bottom portion of the vane body is fitted to the motor bracket, and the vane body may be fixed in an axial direction in a manner that a top portion of the vane body is supported by an impeller housing.

The respective features of the above-described embodiments can be configured in a manner of being combined with other embodiments unless contradictory or exclusive to other embodiments.

Accordingly, a fan motor and manufacturing method thereof according to the present disclosure provide the following effects or advantages.

Firstly, according to an embodiment of the present disclosure, an impeller is a diagonal flow type. Hence, in the impeller, a flow path loss may be reduced and flow path efficiency may be improved, advantageously.

Secondly, according to an embodiment of the present disclosure, a diffuser includes a diagonal flow type. Hence, in the diffuser, a flow path loss may be minimized but flow path efficiency may be maximized, advantageously.

Thirdly, according to an embodiment of the present disclosure, a vane of a diffuser, e.g., a diagonal flow vane is provided to a vaneless section. Hence, the vaneless section between an impeller and the diffuser may be minimized. Hence, a flow path loss may be minimized but flow path efficiency may be maximized, advantageously.

Fourthly, according to an embodiment of the present disclosure, a diagonal flow vane is provided above an axial flow vane of a diffuser, thereby maximizing an overall length of the vane. Hence, a flow path loss may be minimized but flow path efficiency may be maximized, advantageously.

Fifthly, a diffuser consists of two parts including a hub and a vane structure. Hence, manufacture of the diffuser is facilitated.

Sixthly, a vane structure is fixed using another part of a fan motor. Hence, assembling is improved.

Seventhly, a vane is provided within a vane body. Hence, a flow is efficiently guided in the vane.

Effects obtainable from the present disclosure may be non-limited by the above mentioned effect. And, other unmentioned effects can be clearly understood from the following description by those having ordinary skill in the technical field to which the present disclosure pertains.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. The above and other aspects, features, and advantages of the present disclosure will become more apparent upon consideration of the following description of preferred embodiments, taken in conjunction with the accompanying drawing figures. In the drawings.

DETAILED DESCRIPTION

Reference will now be made in detail to a refrigerator according to the preferred embodiment of the present disclosure, examples of which are illustrated in the accompanying drawings. Although description will now be given in detail according to exemplary embodiments disclosed herein with reference to the accompanying drawings, the embodiments and drawings are used to help the understanding of the present disclosure.

Moreover, to help the understanding of the present disclosure, s the accompanying drawings may be illustrated in a manner of exaggerating sizes of some components instead of using a real scale.

Thus, the present disclosure is non-limited to the following embodiment, and it is intended that the present disclosure covers the modifications and variations of this disclosure provided they come within the scope of the appended claims and their equivalents.

Figure 1:
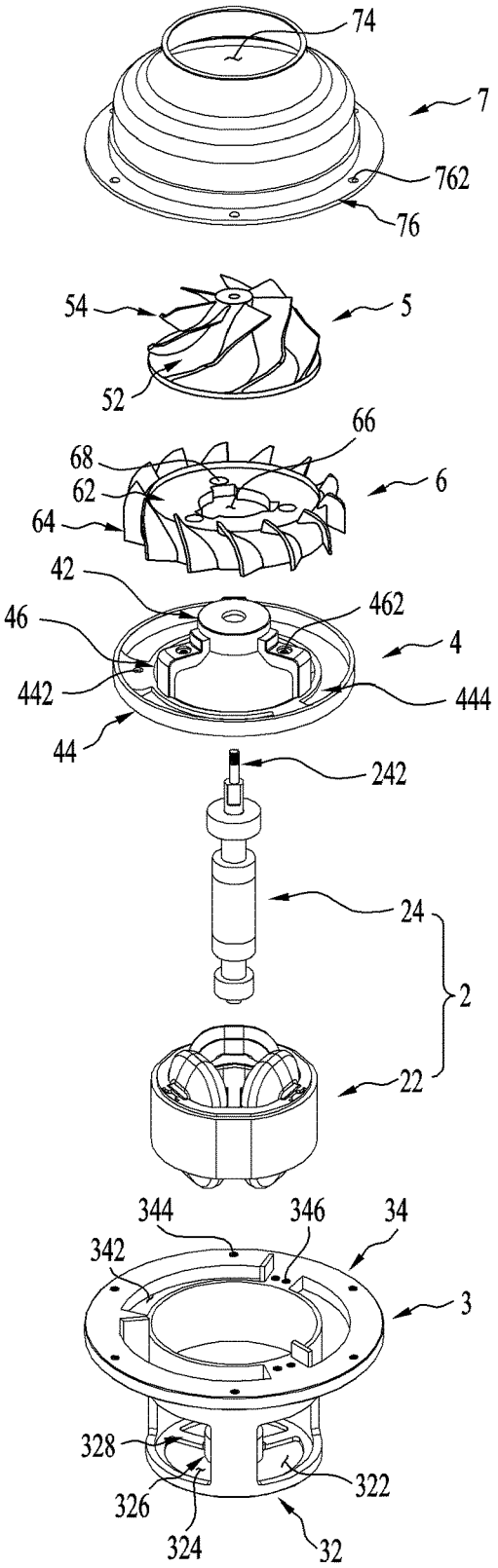
FIG. 1 is an exploded perspective diagram showing a fan motor according to an embodiment of the present disclosure.
Figure 2:
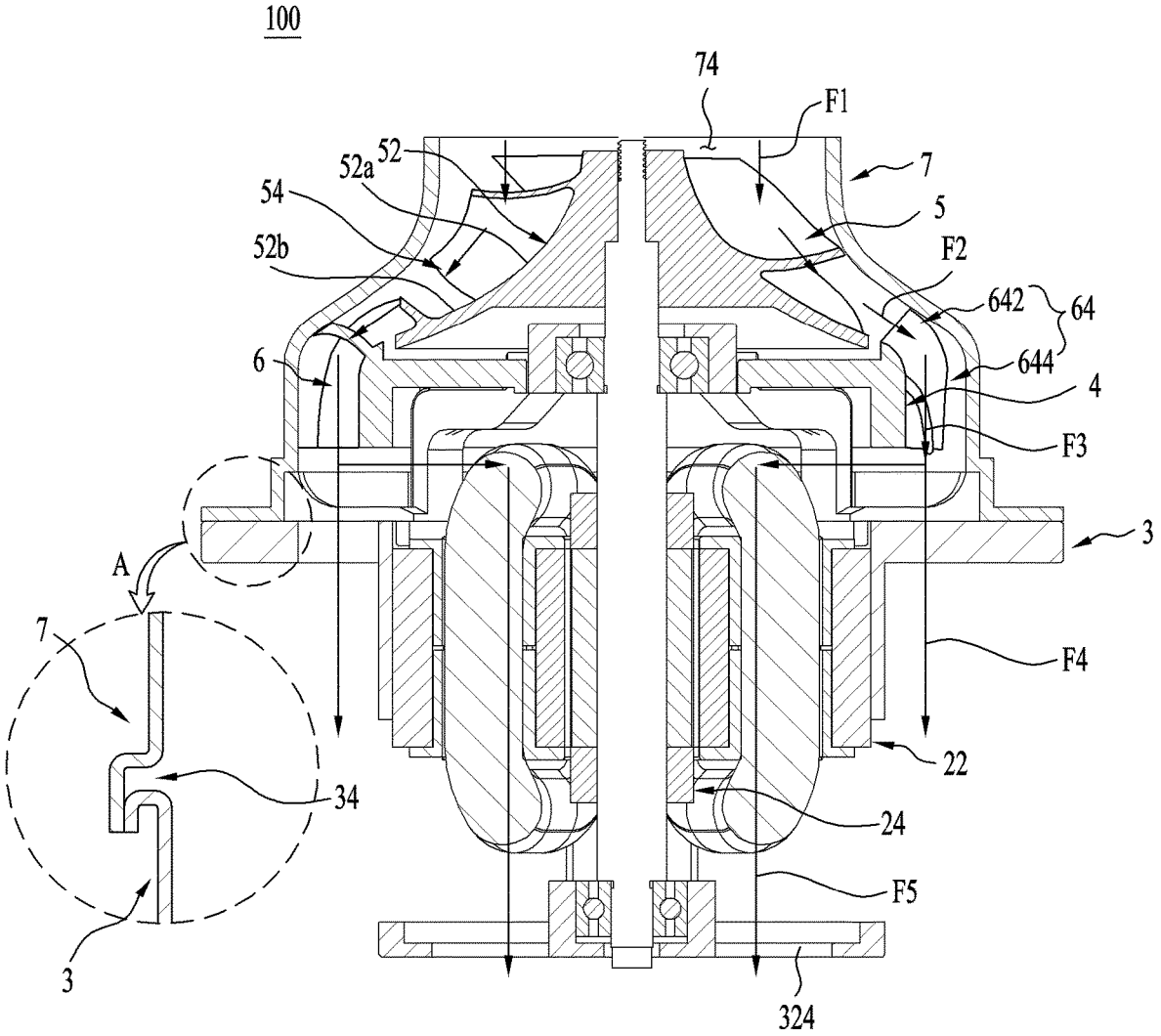
FIG. 2 is a longitudinal cross-sectional diagram of FIG. 1.

An overall configuration of a fan motor 1 according to an embodiment of the present disclosure is described with reference to FIG. 1 and FIG. 2 as follows.

First of all, a motor 2 may include a stator 22 and a rotor 24. An impeller may be coupled to a rotating shaft 242 of the rotor 24. Hence, if the motor 2 rotates, the impeller 5 rotates as well, thereby generating a suction force of sucking air.

A diffuser 6 may be provided between the impeller 5 and the motor 2. The diffuser 6 guides an air flow coming out of the impeller 5 toward a direction of the motor 2.

Meanwhile, the motor 2 may be received in a motor housing 3. A motor bracket 4 may be provided over the motor housing 3. The impeller 5 and the diffuser 6 may be received in an impeller housing 7.

The respective components are described in detail as follows.

First of all, the motor housing 3 is described.

The motor housing 3 may include a body 32 for receiving the motor 2 therein. A coupling part 34 extending in a radial direction may be provided to a top side of the body 32 of the motor housing 3.

The body 32 may have a hollow cylindrical shape overall. An opening 322 in a prescribed shape may be provided to a lateral side of the body 32. And, an opening 324 may be provided to a bottom side of the body 32. Air flowing into the motor housing 3 may be externally discharged through the bottom opening 324 of the body 32.

A bearing housing 326 (hereinafter referred to as 'bottom bearing housing', for clarity) for having a bearing seated therein may be provided to the bottom side of the body 32. And, a connecting part 328 may be provided to connect the bottom bearing housing 326 and the body 32 together.

Meanwhile, the opening 322 in the prescribed shape may be provided to the coupling part 34. A flow coming out of the diffuser 6 may move through the opening 342. A screw fastening recess 344 for coupling to the impeller housing 7 may be provided to the coupling part 34. And, a screw fastening recess 346 for coupling to the motor bracket 4 may be provided to the coupling part 34.

Meanwhile, the stator 22 may be coupled to an inner surface of the body 32 of the motor housing 3. The rotor 24 may be located around the center of the body 32 of the motor housing 3. A bottom side of the rotating shaft of the rotor 24 may be rotatably supported by the bottom bearing housing 326.

The motor bracket 4 is described in the following.

The motor bracket 4 may rotatably support a top portion of the rotating shaft of the rotor 24. Moreover, the motor bracket 4 may support the diffuser 6 by being coupled to the diffuser 6.

Detailed description is made as follows.

A bearing housing (hereinafter referred to as 'top bearing housing' for clarity) may be provided around the center of the motor bracket 4. A support part 44 supported by the coupling part 34 of the motor housing 32 may be provided to an outside of the motor bracket 4. The support part 44 may correspond to a shape of the coupling part 34. For example, the support part 44 may be in a ring shape.

An auxiliary support part 444 may be provided inside the support part 44. The auxiliary support part 444 may be in a ring shape. A part configured to connect the support part 42 and the auxiliary support part 444 together may be provided, and a screw fastening recess 442 may be provided to this part.

The support part 44 may be provided with a screen fastening recess 442 corresponding to the screw fastening recess 346 of the coupling part 34 of the motor housing 3.

A bridge 46 may be provided between the top bearing housing 42 and the support part 44 to connect them together. And, the bridge 46 may be provided with a screw fastening recess 462 corresponding to the screw fastening recess 68 of the diffuser 6. (A specific coupling structure will be described later.)

The impeller housing 7 is described as follows.

First of all, the impeller housing 7 may receive the impeller 5 and the diffuser 6 therein. The impeller housing 7 may be approximately configured in a hollow cylindrical shape. An opening 74 provided to a top side of the impeller housing 7 may become an inlet through which air flows in.

The impeller housing 7 may have a diameter increasing from top to bottom. A coupling part 76 extending in a radial direction may be provided to a bottom side of the impeller housing 7. The coupling part 76 of the impeller housing 7 may be provided with a screw fastening recess 762 corresponding to the screw fastening recess 344 of the coupling part 34 of the motor housing 3.

The coupling relationship of the respective components will be described as follows.

First of all, the top portion of the rotating shaft 242 of the rotor 24 may be rotatably supported by the top bearing housing 42 of the motor bracket 4. The bottom portion of the rotating shaft 24 of the rotor 24 may be rotatably supported by the bottom bearing housing 326 of the motor housing 3. The motor bracket 4 may be screw-fastened to the top side of the motor housing.

The diffuser 6 may be screw-fastened to the top side of the motor bracket 4. And, the impeller 5 may be coupled to the top end of the rotating shaft 242 of the rotor 24.

Meanwhile, the impeller housing 7 and the motor housing 3 may be screw-coupled to each other. Hence, the components of the fan motor 1 may be received in the impeller housing 7 and the motor housing 3.

Alternatively, the impeller housing 7 and the motor housing 3 may be coupled together by another coupling mechanism. For example, a part A shown in FIG. 2 shows another coupling mechanism. As shown in the part A of FIG. 2, the motor housing 3 may be pressed and fitted into the motor housing 3 so as to be coupled thereto. In this case, an edge of the coupling part 34 of the motor housing 3 may be bent downward and then press-fitted into the impeller housing 7.

Figure 3:
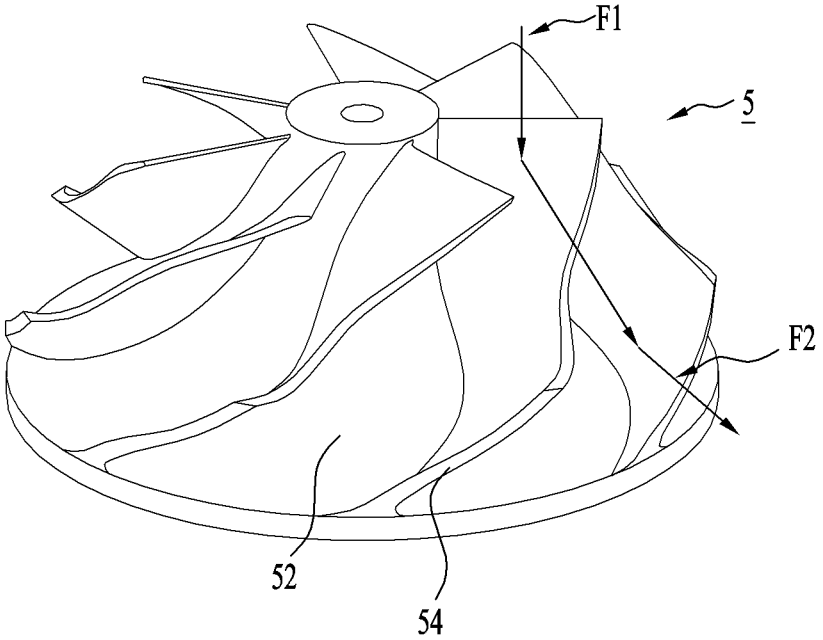
FIG. 3 is a perspective diagram of an impeller shown in FIG. 1.

The impeller 5 of the present embodiment is described with reference to FIG. 3 as follows.

The present embodiment proposes a structure for decreasing a turned angle of a flow coming out of the impeller 5 to reduce a flow path loss.

The impeller 5 of the present embodiment may be a diagonal flow type. A flow F1 entering the impeller 5 through the inlet 74 of the impeller housing 7 almost follows an axial direction. Yet, a flow F2 coming out of the impeller 5 may have a prescribed inclination.

For example, the impeller 5 may be configured in a manner that a direction of the flow F2 coming out of the impeller 5 has an inclination between a diameter direction (0°) and the axial direction (90°). The direction of the flow F2 coming out of the impeller 5 may include about 45°.

Detailed description is made as follows.

The impeller 5 may include a hub 52 and a multitude of blades 54 provided to the hub 52. Here, the hub 52 may have an approximately circular shape. The blades 54 may be provided to a top side of the hub 52.

The direction of the flow F2 coming out of the impeller 5 may be set to have a prescribed downward inclination from a radial direction. To this end, the impeller 5 may be configured to be inclined further downward from horizontality. For example, in case of viewing a vertical cross-section of the hub 52 of the impeller 5, an inclination of a hub top surface 52*a* and 52*b* may be configured to have an angle between 0° and 90°, and preferably, 45°. Alternatively, the top surface of the hub 52 may be configured to have an inclination getting closer to the axial direction from the top side 52*a* toward the bottom side 52*b*. According to this configuration, a flow may be generated in a manner of getting proximate to the axial direction toward an outside from the hub 52 (See FIG. 2).

With the above configuration, the direction of the flow F2 coming out of the impeller 5 may become more slant downward than the diameter direction. Thus, the direction of the flow coming out of the impeller 5 may be prevented from being rapidly turned in the diameter direction. Therefore, a flow path loss may be minimized but flow path efficiency may be maximized.

Compared to a flow direction of a centrifugal impeller of the related art, a flow direction of the impeller 5 of the present embodiment is considerably inclined downward, i.e., in the axial direction so as to increase a flow rate of the axial direction. Therefore, a flow rate through the fan motor 1 increases, whereby a suction capability of the fan motor 1 increases.

Compared to a flow rate of a centrifugal impeller of the related art, a flow rate of the impeller 5 of the present embodiment is high. According to the comparison with the same reference, the number of blades of the impeller can be reduced. For example, if the number of blades of the centrifugal impeller of the related art is 9, although the number of the blades 54 of the impeller 5 of the present embodiment is reduced to 7, a sufficient flow rate can be secured.

In addition, if the number of the blades 54 of the impeller 5 is reduced, the shaft power applied to the impeller 5 is reduced. Therefore, since it is possible to reduce the shaft power in the impeller 5 of the present embodiment, efficiency of the fan motor 5 is raised.

Figure 4:
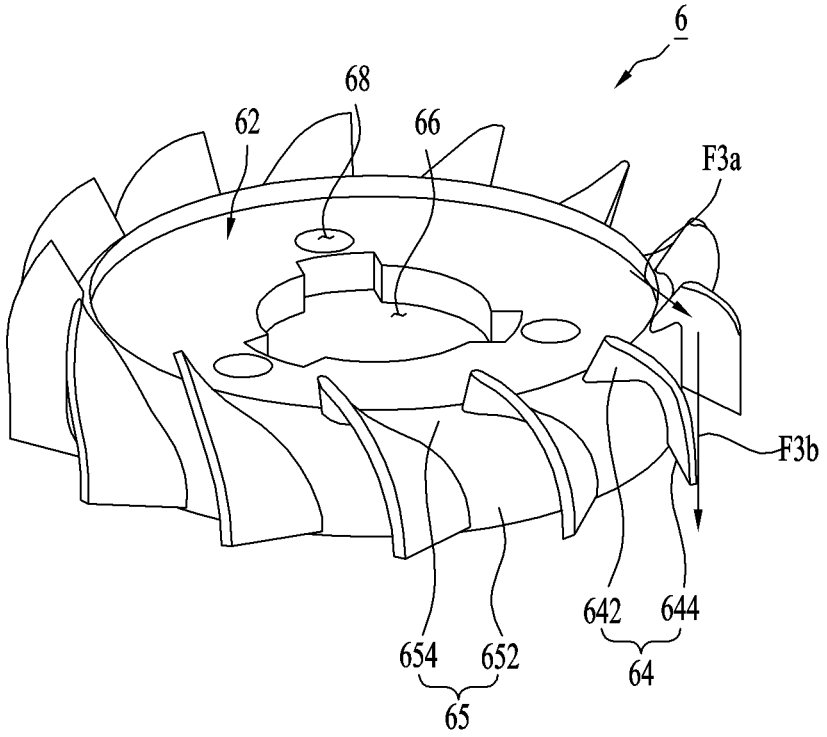
FIG. 4 is a perspective diagram of a diffuser shown in FIG. 1.

Another embodiment of the fan motor 1 is described with reference to FIG. 4.

A diffuser 6 of the present embodiment is described as follows.

First of all, a diffuser 6 may include a diffuser hub 62 and a vane 64. Particularly, a multitude of vanes 64 may be provided.

The diffuser hub 62 may be configured in a disk shape. An opening 66, in which the bearing housing 42 of the motor bracket 4 is inserted, may be provided to the diffuser hub 62. A shape of the opening 66 of the diffuser hub 62 may correspond to a shape of the bearing housing 42 of the motor bracket 4. Moreover, the diffuser hub 62 may be provided with a screw fastening recess 68 for screw-fastening the motor bracket 4 and the diffuser hub 62 to each other.

In some implementations, a multitude of the vanes 64 may be provided to an outer circumference 65 of the diffuser hub 62. Each of the vanes 64 may include an axial flow vane 644 and a diagonal flow vane 642. The diagonal flow vane 642 may play a diffusing role, and the axial flow vane 644 may play a role in increasing a flow rate by changing a flow direction into a downward direction.

The diagonal flow vane 642 may be located above the axial flow vane 644. For example, the axial flow vane 644 may be provided to a lateral side 652 of the outer circumference of the diffuser hub 62. The diagonal flow vane 642 may be provided to a top side 654 of the outer circumference of the diffuser hub 62. The diagonal flow vane 642 may be in a shape that an angle of a leading edge is inclined.

The axial flow vane 644 and the diagonal flow vane 642 may be separately provided. Preferably, the axial flow vane 644 and the diagonal flow vane 642 are connected continuously as a single vane.

In some implementations, generally, a space between the impeller 5 and the diffuser 6 is a vaneless section having no vane existing therein. Yet, a flow path loss is considerable in the vaneless section. Hence, a size of the diagonal flow vane 642 may become a size capable of covering the vaneless section if possible. For example, a top end of the diagonal vane 642 may be provided to be substantially adjacent to a bottom side of the impeller 5.

Meanwhile, the longer a total length of the vane of the diffuser 6 becomes, the better the vane gets. This is because a flow coming out of the impeller 5 can be guided more effectively if the total length of the vane gets longer. Hence, the total length of the vane of the diffuser 6 is preferably set longer. Besides, there is not much clearance under the diffuser 6. Hence, a length of the vane is extended over the diffuser 6.

Yet, in the present embodiment, the diagonal flow vane 642 may be provided above the axial flow vane 644. Namely, according to the present embodiment, the total length of the vane 64 gets longer by the length of the diagonal flow vane 642 without extending the length of the axial flow vane 644. Of course, at least one of the length of the axial flow vane 644 and the length of the diagonal flow vane 642 may be possibly increased.

An operation of the diffuser 6 according to the present embodiment is described with reference to FIG. 3 and FIG. 4 as follows.

In the present embodiment, the diagonal flow vane 642 is located at the portion where the flow F2 coming out of the impeller 5 flows into the diffuser 6. Hence, the flow F2 coming out of the impeller 5 is first guided by the diagonal flow vane 642, thereby becoming a flow F3*a* in an inclination direction. Hence, the flow coming out of the impeller 5 may move in a direction of the diffuser 6 more efficiently without a flow path loss.

Namely, the flow coming out of the impeller 5 is naturally discharged downward by the diagonal flow vane 642. Thus, the diagonal flow vane 642 restrains a rotation component of the flow and helps the flow to escape efficiently.

In addition, if the impeller 5 is a diagonal flow impeller, the flow escaping from the impeller 5 in a diagonal flow form may move more naturally along the diagonal flow vane 642. This is because the flow escaping from the impeller 5 in a diagonal flow form is naturally accepted by a start point of the diagonal flow vane 642. Moreover, a flow F3 guided to the diagonal flow vane 642 is delivered as a flow F3*b* in a motor direction by the axial flow vane 644.

Therefore, according to the present embodiment, a flow path loss may be minimized and flow path efficiency may be maximized. And, suction capability of the fan motor 1 may be raised efficiently.

Moreover, in the present embodiment, the diagonal flow vane 642 may be provided above the axial flow vane 644. Therefore, the diagonal flow vane 642 may be provided to the vaneless section, thereby minimizing the vaneless section between the impeller 5 and the diffuser 6.

In addition, in the present embodiment, a vane, e.g., the diagonal flow vane 642 may be additionally provided above the axial flow vane 644. Therefore, the total length of the vane of the diffuser 6 is increased, whereby a significant diffusing effect is obtained.

Operations of the fan motor 1 according to the present embodiment are described with reference to FIG. 2 as follows.

First of all, once the motor 2 rotates, the impeller 5 connected to the rotating shaft of the motor 2 is rotated. If the impeller 5 is rotated, air is sucked in through the inlet 74 of the impeller housing 7. Namely, a flow F1 in an approximately axial direction is generated.

The air sucked into the impeller housing 7 flows in the direction of the impeller 5. Here, the impeller 5 of the present embodiment may include a diagonal flow impeller. Hence, the flow F2 coming out of the impeller 5 moves downward at a prescribed inclination from a diameter direction. For example, the flow F2 may approximately lie between a radial direction and an axial direction. Namely, a direction of the flow F2 coming out of the impeller 5 is not turned rapidly. Thus, according to the present embodiment, a flow path loss is reduced.

The flow F2 coming out of the impeller 5 is naturally guided by the diagonal flow vane 642 of the diffuser 6 first. The flow F3 passing through the diagonal flow vane 642 becomes the flow F3B in the approximately axial direction by the axial flow vane 644. Namely, as the air flow is naturally guided in the diffuser 6, a flow path loss is reduced (See FIG. 3).

One portion of the flow coming out of the diffuser 6 becomes a flow F5 moving into the motor housing 3. The air flowing into the motor housing 3 cools down the motor 2 and is then externally discharged through the bottom opening 324 of the motor housing 3. The other portion of the flow coming out of the diffuser 6 becomes a flow F4 directly coming out of the motor housing.

In some implementations, when the fan motor according to the present disclosure is used for a cleaner, both of the flow F5 having passed through the motor housing 3 and the flow F4 failing to pass may move to a filter of the cleaner.

In the above-described embodiment, a fan motor having a diagonal flow impeller and an axial-diagonal flow diffuser is taken as an example. Yet, the axial-diagonal flow diffuser is applicable to a fan motor having a centrifugal impeller as well. And, a diagonal flow impeller is usable for a fan motor having an axial flow diffuser as well.

Figure 5:
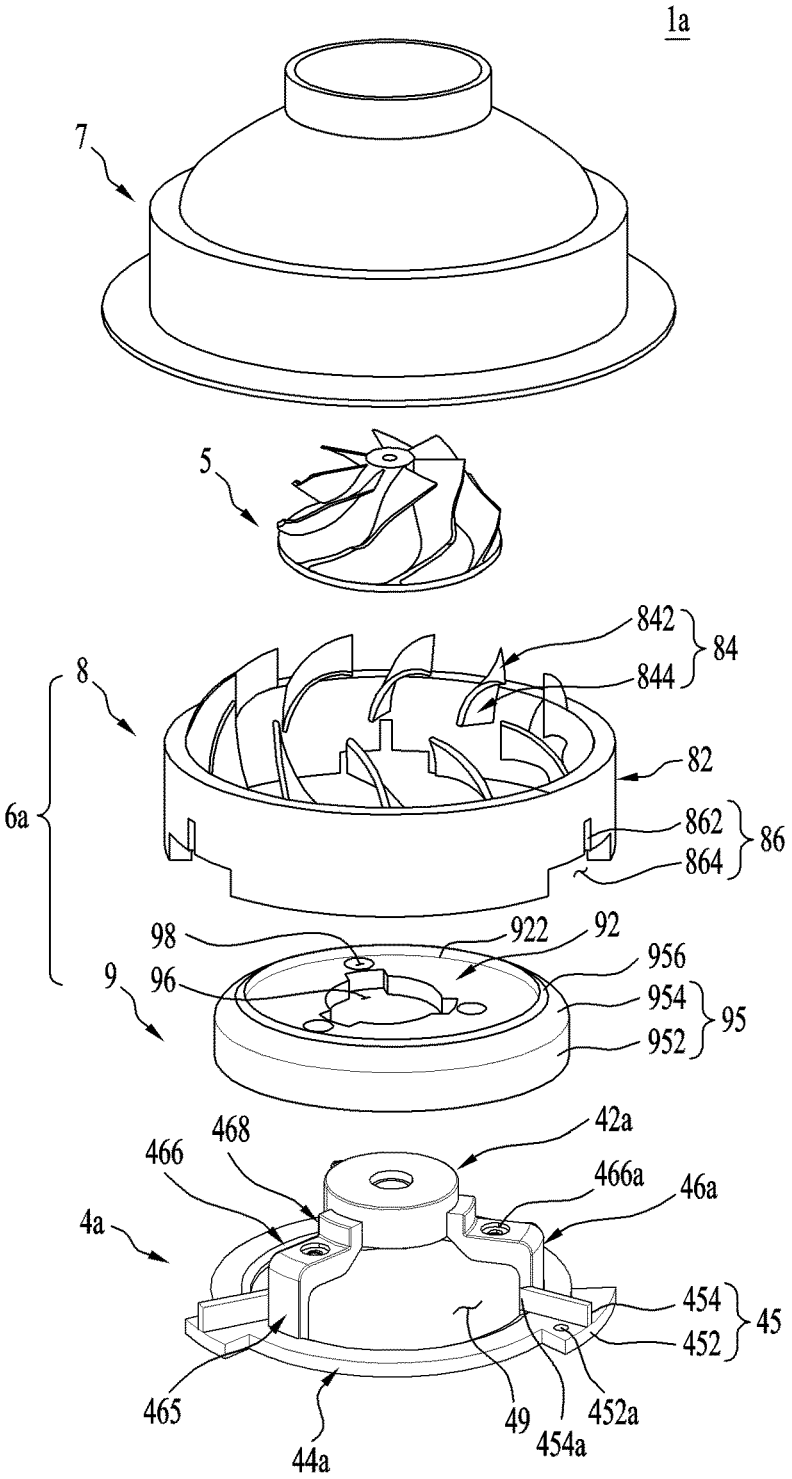
FIG. 5 is an exploded perspective diagram showing a fan motor according to another embodiment of the present disclosure.

A fan motor 1*a* according to another embodiment of the present disclosure is described with reference to FIG. 5.

The basic principle of the present embodiment is substantially similar to that of the aforementioned embodiment. Yet, the present embodiment differs from the aforementioned embodiment in a structure of a diffuser. For clarity of description, the description of the substantially same components of the aforementioned embodiment will be skipped.

Manufacturing of the diffuser 1 of the aforementioned embodiment is not facilitated. For example, injection of the diffuser of the aforementioned embodiment is not facilitated. This is because a diagonal flow vane is provided to a top surface of an outer circumference of a hub in the diffuser of the aforementioned embodiment. The top surface of the outer circumference of the hub is a curved surface and the diagonal flow vane is provided to the curved surface. Thus, it is difficult to manufacture the diffuser 1 of the aforementioned embodiment using the injection.

Accordingly, the present embodiment proposes a diffuser of which manufacturing is facilitated. In the present embodiment, it is proposed to separate a diffuser into two parts to facilitate the manufacturing of the diffuser. In the present embodiment, it is proposed to fix the separated two parts without using screws and the like. For example, it is proposed to fix the two parts using peripheral parts of a vane.

A diffuser 6*a* of the present embodiment is described in detail as follows.

First of all, a diffuser 6*a* of the present embodiment may include a hub 9 and a vane 84 separated from the hub 9. In the present embodiment, the hub 9 and the vane 84 are prepared separately (by injection molding) and then assembled into the diffuser 6*a*. In the present embodiment, as the vane 84 is separated from the hub 9, a contact surface between the vane 84 and the hub 9 is removed. Hence, the vane 84 and the hub 9 may be easily manufactured (by injection molding for example).

The hub 9 is described as follows.

The hub 9 of the present embodiment may be configured in a manner of removing the vane from the hub in the aforementioned embodiment. One example of the hub 9 of the present embodiment is described as follows.

The hub 9 may include a center part 92 and a circumference part 95 located on an outer circumference of the center part 92. The center part 92 may be in a disk shape and the circumference part 95 may be in a cylindrical shape. The center part 92 and the circumference part 95 may be integrally formed.

The center part 92 may be provided with an opening 96. A shape of the opening 96 may correspond to a shape of a bearing housing 42*a* of a motor bracket 4*a*, and the bearing housing 42*a* may be inserted in the opening 96. And, the center part 92 may be provided with a screw-fastening recess 98 for the screw fastening to the motor bracket 42*a*.

A prescribed step difference 933 may exist between the center part 92 and the circumference part 95.

A top side of the circumference part 95 may be provided as a curved surface. For example, the top side 954 of the circumference part 95 may be extended in a center direction with a curved surface. A top end portion 956 of the top side 954 may have a horizontal surface.

The top side 954 and/or the top end portion 956 of the circumference part 95 may play a role in supporting the vane 84, and more particularly, a diagonal follow vane 842. To this end, a curvature of the top side 954 and/or the top end portion 956 of the hub 9 may correspond to a shape of the diagonal flow vane 842.

The vane 84 is described as follows.

Generally, a multitude of the vanes 84 may be provided. It is preferable to manufacture a multitude of the vanes 84 together rather than to manufacture a multitude of the vanes 84 individually. To this end, in order to hold a multitude of the vanes 84 by a single part or component, a separate part of component is used preferably.

For example, a multitude of the vanes 84 may be provided to a body (hereinafter referred to as 'vane body') in a prescribed shape. (Both of the vane 84 and the vane body 82 will be collectively referred to as 'vane structure 8'.)

The vane body 82 may include a hollow member. For example, the vane body 82 may be in a ring or cylindrical shape. The vane 84 may be provided inside the vane body 82.

The vane 84 may include an axial flow vane 844 and a diagonal flow vane 842. The shapes of the axial flow vane 844 and the diagonal flow shape vane 842 in the present embodiment may be substantially identical to those of the axial flow vane and the diagonal flow vane of the aforementioned embodiment.

In some implementations, at least one portion of the axial flow vane 844 may be connected to an inner surface of the vane body 82. The diagonal flow vane 842 may be configured in a manner of being extended from a top side of the axial flow vane 844.

The diagonal flow vane 842 may be configured in a manner of being extended from a top end of the axial flow vane 844 upward in a center direction of the vane body 82. The diagonal flow vane 842 may be connected to the axial flow vane 844 without being connected to the vane body 82.

Meanwhile, an indentation 86 in a prescribed shape may be provided to a bottom side of the vane body 82. The indentation 86 may be fitted into a prescribed portion of the motor bracket 4*a*, thereby playing a role in fixing the vane body 82 thereto.

The shape of the indentation 86 of the vane body 82 is non-limited. For example, the indentation 86 may include a first indentation 864 provided in a circumferential direction. And, the indentation 86 may include a second indentation 862 provided in an axial direction.

The indentation 86 may include a combination of at least one of the first indentation 864 and the second indentation 862. If the indentation 86 includes both of the first indentation 864 and the second indentation 862, it may have an approximately inverse 'T' shape.

In the following, the motor bracket 4*a* is described.

The motor bracket 4*a* of the present embodiment may be basically identical to the former motor bracket of the aforementioned embodiment. Yet, in the present embodiment, a prescribed portion of the motor bracket 4*a* may be fitted to a prescribed portion of the vane body 82. For example, the motor bracket 4*a* of the present embodiment may have a portion fitted into the indentation provided to the vane body 82.

The motor bracket 4*a* may include a bearing housing 42*a*, a support part 44*a* and a bridge 46*a* connecting the bearing housing 42*a* and the support part 44*a* to each other.

The bearing housing 42*a* may be in a shape capable of receiving a bearing provided to a top side of the rotating shaft of the motor. A shape of the support part 44*a* may correspond to a shape of the coupling part 34 of the motor hosing 3. For example, the support part 44*a* may be in a ring shape. And, the support part 44*a* may be provided with a screw fastening recess 452*a*.

The motor bracket 4*a* may include a fitted part 45 fitted into the indentation 86 of the vane body 82. The fitted part 45 may be provided in a shape corresponding to the indentation 86 of the vane body 82. A multitude of the fitted parts 45 may be provided in a manner of being spaced apart from each other by a prescribed distance in a circumferential direction.

For example, the fitted part 45 may include a first fitted part 452 corresponding to the first indentation 864 of the vane body 82. The first fitted part 452 may be provided in a manner of being extended from the support part 44*a* in a diameter direction. The first fitted part 452 may include a plate-type member having a prescribed small thickness.

The screw fastening recess 452*a* for the screw coupling to the motor housing 3 may be provided to the support part 44*a* or the first fitted part 452.

The fitted part 45 may include a second fitted part 454 corresponding to the second indentation 862 of the vane body 82. The second fitted part 454 may be provided in a manner of being extended from the support part 454 in the axial direction. The second fitted part 454 may include a plate-type member of small thickness.

The bridge 46*a* may employ any shape capable of performing a function of connecting the bearing housing 42*a* and the support part 44*a* together. For example, the bridge 46*a* may be in a narrow bar shape.

One side of the bridge 46*a* may be connected to the bearing housing 42*a* and the other side may be connected to the support part 44*a*. Yet, since there is a height difference between the bearing housing 42*a* and the support part 44*a*, there may be a height difference between top and bottom ends of the bridge 46*a*.

For example, the bridge 46*a* may include a horizontal part 466 and a vertical part 465. One side of the horizontal part 466 may be connected to the bearing housing 42*a* and the other side may be connected to the vertical part 465. One side of the vertical part 465 may be connected to the horizontal part 466 and the other side may be connected to the support part 44*a*. The horizontal part 466 may be provided with the screw fastening recess 466*a* for the screw coupling to the hub 9.

Meanwhile, one end 454*a* of the second fitted part 454 may be connected to a lateral side of the vertical part 465. If so, the second fitted part 454 may bear a rotational force generated by an air flow more effectively.

Namely, the second fitted part 454 may greatly receive the rotational force generated by the flow coming out of the impeller 5. Yet, if one end 454*a* of the second fitted part 454 is connected to the lateral side of the vertical part 465, the rotational force generated by the flow coming out of the impeller 5 may be supported by the lateral side of the vertical part 465 as well.

In addition, a top end 468 of the horizontal part 466 may extend vertically so as to contact with the lateral side of the bearing housing 42*a*.

Fixed mechanisms of the hub 9 and the vane structure 8 are described as follows.

The fixed mechanism of the hub 9 is described with reference to FIG. 5.

The motor housing 3 and the motor bracket 4*a* may be coupled together. And, the hub 9 may be coupled to the motor bracket 4*a*.

The coupling of the motor bracket 4*a* and the hub 9 is described as follows.

The bearing housing 42*a* of the motor bracket 4*a* is inserted in the opening 96 of the hub 9. In this state, the hub 9 and the motor bracket 4*a* are assembled by screw fastening. Hence, the hub 9 is solidly fixed in the rotation direction and the axial direction.

Figure 6:
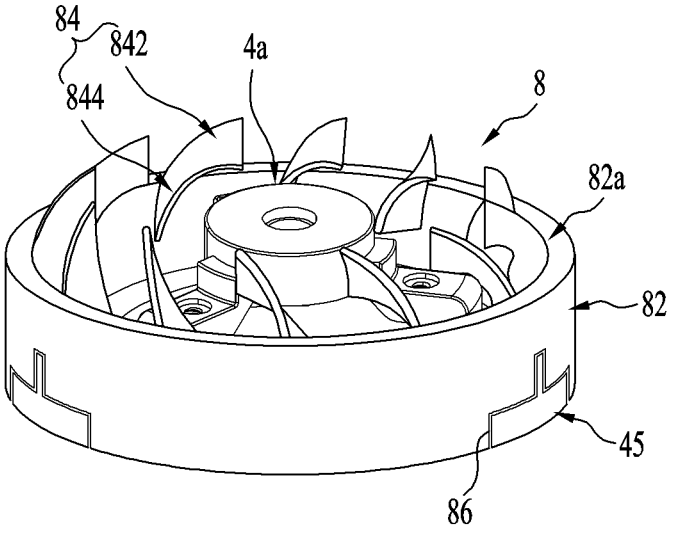
FIG. 6 is a perspective diagram of a vane structure coupled to a motor bracket shown in FIG. 5.

A rotation-directional (arc-directional) fixed mechanism of the vane structure 8 is described with reference to FIG. 5 and FIG. 6.

As described above, in the present embodiment, the vane structure 8 may be provided as a member separate from the hub 9. Hence, a mechanism appropriate for fixing the vane structure 8 is required. Proposed in the present embodiment is a mechanism of fixing the vane structure 8 without using a fastening mechanism such as a screw and the like.

This is described in detail as follows.

First of all, the impeller 5 is rotated at high speed, whereby a flow coming out of the impeller 5 has a strong force in a rotation direction. Hence, when the flow coming out of the impeller 5 passes through the vane 84 of the diffuser 6*a*, a force applied to the vane 84 in the rotation direction is strong. Thus, a force applied to the vane body provided with a multitude of the vanes 84 in the rotation direction is strong as well. Accordingly, it is preferable to solidly fixe the vane body 82.

The vane body 82 may be fixed by the motor bracket 4*a*. Yet, in the present embodiment, the vane body 82 may be fixed without being screw-fastened to the motor bracket 4*a*.

Namely, as described above, if the vane body 82 is seated on the motor bracket 4*a*, the fitted part 45 of the motor bracket 4*a* is fitted to the indentation 86 of the vane body 82. Thus, although a strong force in the rotation direction is applied to the vane body 82, the fitted part 45 of the motor bracket 4*a* prevents the vane body 82 from being rotated. Therefore, the vane body 82 is solidly fixed in the rotation direction.

In the above embodiment, the mechanism of fixing the vane structure 8 without using a fastening mechanism such as a screw is described, by which the present disclosure is non-limited. And, it is possible to fix the vane structure 8 using a fastening mechanism such as a screw.

Figure 7:
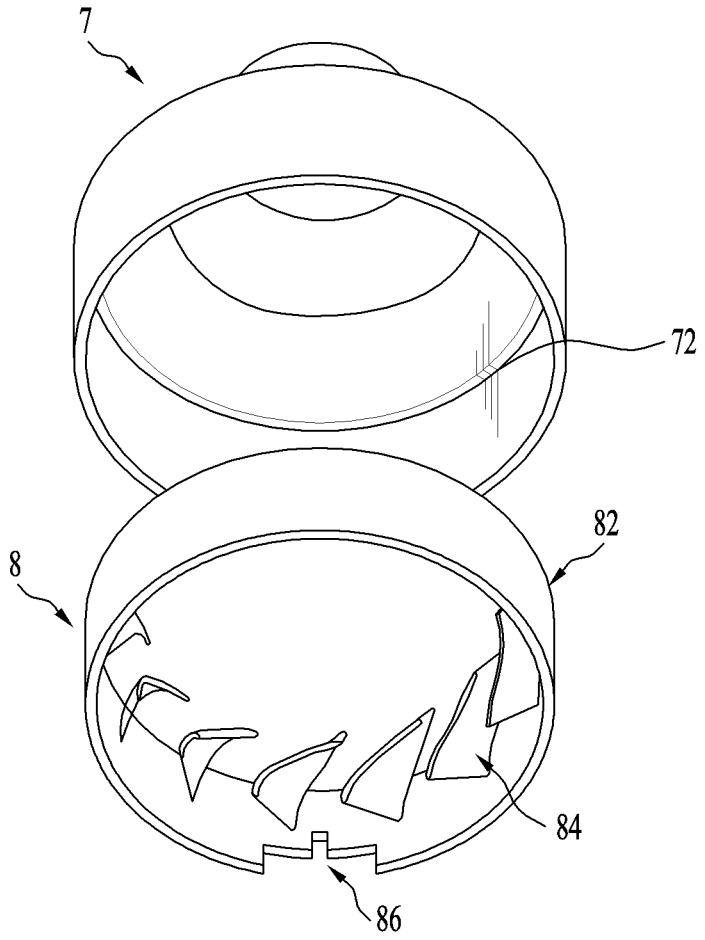
FIG. 7 is an exploded perspective diagram of an impeller housing and a vane structure shown in FIG. 5.
Figure 8:
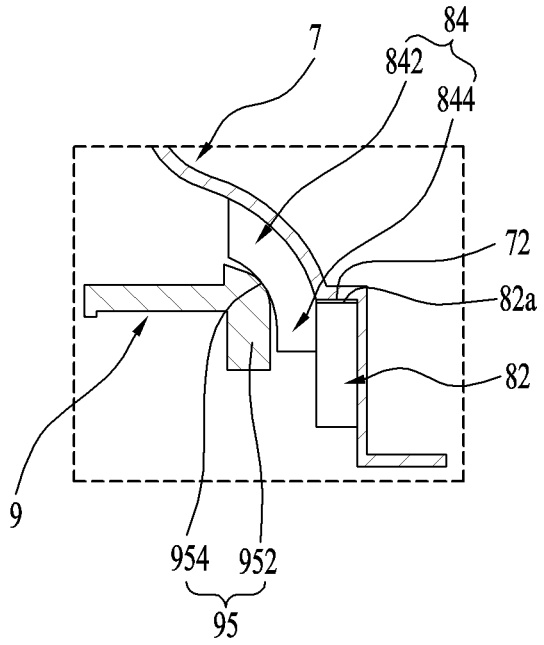
FIG. 8 is a cross-sectional diagram showing the coupling shown in FIG. 7.

The axial direction fixed mechanism of the vane structure 8 is described with reference to FIG. 7 and FIG. 7.

In the present embodiment, the mechanism of fixing the vane structure 8 without using a fastening mechanism such as a screw is proposed.

The vane body 82 is supported by the impeller hosing 7. And, the vane body 82 is supported by the motor bracket 4*a*. For example, a top portion of the vane body 82 may be supported by the impeller housing 7, and a bottom portion of the vane body 82 may be supported by the motor bracket 4*a*.

In this state, the impeller housing 7 and another portion (e.g., motor housing 3) of the fan motor are coupled together, whereby the vane body 82 may be fixed in the axial direction more solidly.

This is described in detail as follows.

A portion for supporting the vane body 82 may be provided to the impeller housing 7. For example, a prescribed step difference 72 may be provided to an inner surface of the impeller housing 7. And, the top portion 82*a* of the vane body 82 may be supported by the step difference 72 of the impeller housing 7. Furthermore, an inner diameter of the impeller hosing 7 may correspond to an outer diameter of the vane body 82.

The bottom portion of the vane body 82 may be supported by the motor bracket 4*a*. As described above, as the fitted part 45 of the motor bracket 4*a* is fitted to the indentation 86 of the vane body 82, the bottom portion of the vane body 82 may be supported by the motor bracket 4*a* more solidly.

In this state, the impeller housing 7 is coupled to the motor housing 3. The impeller housing 7 may be mutually coupled to the motor housing 3 by screw fastening or press fitting.

Namely, in the state that the vane body 82 is supported by the impeller housing 7, the impeller housing 7 and the motor housing 3 are coupled together in the axial direction. If so, a force in the axial direction is applied to the vane body 82 supported by the impeller housing 7. Hence, a force in the axial direction is applied to the top side 82*a* of the vane body 82 by the step difference 72 of the impeller housing 7. Therefore, the vane body 82 may be solidly fixed in the axial direction without a separate fastening mechanism.

In the present embodiment, the step difference 72 is provided to the impeller housing 7, and the vane body 82 is supported by the impeller housing using the step difference 72, by which the present disclosure is non-limited. Alternatively, the impeller housing 7 and the vane body 82 may be supported in other ways.

In some implementations, the vane 84 provided to eh vane body 82, and more particularly, the diagonal flow vane 842 may be seated on the top portion 954 of the hub 9 so as to be fixed in the axial direction.

According to the present embodiment, the vane 84 is located inside the vane body 82 in the ring shape. Hence, the air coming out of the impeller 5 flows between the inside of the vane body 82 in the ring shape and the outside of the hub 9. Hence the air flow may be guided more smoothly.

In the present embodiment, a diffuser having an axial-diagonal flow vane is described, by which the present disclosure is non-limited, and the principle of the present disclosure is applicable to a diffuser having an axial flow vane only.

The matter of the above-described embodiment is identically applicable to other undescribed parts. Moreover, the technical matter described in one embodiment is identically applicable to another embodiment if it is not contrary mutually, unless otherwise specifically stated.

The above-described embodiments and drawings are used to help the understanding of the present disclosure. It will be appreciated by those skilled in the art that various modifications and variations can be made in the present disclosure without departing from the spirit or scope of the disclosures.

For example, a fan motor for a cleaner is described in the aforementioned embodiment, by which the present disclosure is non-limited. For example, the aforementioned fan motor is usable for home appliances other than the cleaner, vehicles, etc.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A fan motor, comprising:

a motor housing;

a motor disposed within the motor housing;

a motor bracket disposed on a top side of the motor housing;

an impeller coupled to a shaft of the motor;

an impeller housing that receives the impeller therein; and a diffuser disposed between the motor and the impeller, the diffuser comprising:

a hub coupled to the motor bracket, a vane body that has a ring and is supported by an inside of the impeller housing, the vane body being separate from the hub and disposed outside the hub, and a vane integrally provided with the vane body and disposed at an inner circumference of the vane body, wherein the vane comprises an axial flow vane and a diagonal flow vane that is disposed at a top side of the axial flow vane, wherein the impeller housing comprises a step difference portion that is defined at an inner surface of the impeller housing and that contacts a top portion of the vane body, wherein an inner diameter of the impeller housing is greater than or equal to an outer diameter of the vane body, and wherein a top surface of an outer circumference of the hub supports the diagonal flow vane.

2. The fan motor of claim 1, wherein the vane body defines an indentation, and the motor bracket comprises a fitted part inserted into the indentation.

3. The fan motor of claim 2, wherein the indentation comprises at least one of a first indentation that extends along a circumferential direction of the vane body or a second indentation that extends along an axial direction of the vane body, and wherein the fitted part comprises at least one of a first fitted part inserted into the first indentation or a second fitted part inserted into the second indentation.

4. The fan motor of claim 3, wherein the motor bracket comprises a bearing housing, a support part that is spaced apart from the bearing housing, and a bridge that connects the bearing housing to the support part, and wherein the fitted part is disposed at an outside of the support part.

5. The fan motor of claim 4, wherein the second fitted part is connected to a lateral side of the bridge.

6. The fan motor of claim 1, wherein the hub comprises:

a center part that has a disk shape and is coupled to the motor bracket; and a circumference part that extends along an outer circumference of the center part and protrudes toward the motor bracket.

* * * * *